US010629424B2

(12) United States Patent
Berkout et al.

(10) Patent No.: US 10,629,424 B2
(45) Date of Patent: Apr. 21, 2020

(54) LOW TEMPERATURE PLASMA PROBE WITH AUXILIARY HEATED GAS JET

(71) Applicant: Smiths Detection, Inc., Edgewood, MD (US)

(72) Inventors: Vadym Berkout, Rockville, MD (US); Thomas D. Saul, Edgewood, MD (US)

(73) Assignee: SMITHS DETECTION INC., Edgewood, MD (US)

( * ) Notice: Subject to any disclaimer, the term of this patent is extended or adjusted under 35 U.S.C. 154(b) by 0 days.

(21) Appl. No.: 16/111,185

(22) Filed: Aug. 23, 2018

(65) Prior Publication Data

US 2018/0366309 A1 Dec. 20, 2018

Related U.S. Application Data

(63) Continuation of application No. 15/223,200, filed on Jul. 29, 2016, now Pat. No. 10,096,456.

(51) Int. Cl.

| | |
|---|---|
| ***H01J 49/06*** | (2006.01) |
| ***H01J 49/26*** | (2006.01) |
| ***H01J 49/00*** | (2006.01) |
| ***H01J 49/04*** | (2006.01) |
| ***H01J 49/10*** | (2006.01) |

(52) U.S. Cl.

CPC ..... *H01J 49/062* (2013.01); *H01J 49/0027* (2013.01); *H01J 49/0404* (2013.01); *H01J 49/0477* (2013.01); *H01J 49/26* (2013.01); *H01J 49/105* (2013.01)

(58) Field of Classification Search

CPC ..... H01J 49/062; H01J 49/0027; H01J 49/26; H01J 49/14; H01J 49/142; H01J 49/145; H01J 37/32009; H01J 27/022

USPC ..... 250/281, 282, 283, 288

See application file for complete search history.

(56) References Cited

U.S. PATENT DOCUMENTS

| | | | |
|---|---|---|---|
| 9,064,674 | B2 | 6/2015 | Ouyang et al. |
| 2008/0067352 | A1 | 3/2008 | Wang |
| 2011/0168881 | A1 | 7/2011 | Sturgeon et al. |
| 2014/0011282 | A1 | 1/2014 | Ouyang et al. |
| 2014/0224984 | A1 | 8/2014 | Morrisroe |
| 2015/0355148 | A1 | 12/2015 | Bajic |

FOREIGN PATENT DOCUMENTS

WO 2015070352 A1 5/2015

OTHER PUBLICATIONS

International Preliminary Report on Patentability dated Jan. 29, 2019, for PCT/US17/43455.

(Continued)

*Primary Examiner* — Nicole M Ippolito
*Assistant Examiner* — Hanway Chang
(74) *Attorney, Agent, or Firm* — Kevin E. West; Advent, LLP

(57) ABSTRACT

A low temperature plasma probe, a mass spectrometry system, and a method for using a low temperature plasma probe are described. In an embodiment, a low temperature plasma probe includes an intake capillary that provides an ion flow from a sample surface to a mass spectrometer; at least one low temperature plasma tube that provides low temperature plasma gas; at least one heated gas tube that provides heated gas to the sample surface, where the heated gas enhances desorption and ionization of a sample on the sample surface.

20 Claims, 8 Drawing Sheets

(56) References Cited

OTHER PUBLICATIONS

Garcia-Reyes, Juan F. et al., "Detection of Explosives and Related Compounds by Low-Temperature Plasma Ambient Ionization Mass Spectrometry". Anal. Chem., 2011, 83 (3) 1084-1092.
International Search Report and Written Opinion dated Oct. 6, 2017 for PCT/US17/43455.

LOW TEMPERATURE PLASMA PROBE WITH AUXILIARY HEATED GAS JET

FEDERALLY SPONSORED RESEARCH OR DEVELOPMENT

This invention was made with Government support under contract HSHQDC-15-C-B0027 with the Department of Homeland Security. The Government has certain rights in this invention.

BACKGROUND

Mass spectrometers (MS) operate in a vacuum and separate ions with respect to mass-to-charge ratio. In some embodiments using a mass spectrometer, a sample, which may be solid, liquid, or gas, is ionized. The ions are separated in a mass analyzer according to mass-to-charge ratio and are detected by a device capable of detecting charged particles. The signal from a detector in the mass spectrometer is then processed into spectra of the relative abundance of ions as a function of the mass-to-charge ratio. The atoms or molecules are identified by correlating the identified masses with known masses or through a characteristic fragmentation pattern.

SUMMARY

A low temperature plasma probe, a mass spectrometry system, and a method for using a low temperature plasma probe are described. In an embodiment, a low temperature plasma probe includes an intake capillary that provides an ion flow from a sample surface to a mass spectrometer; at least one low temperature plasma tube that provides low temperature plasma gas; at least one heated gas tube that provides heated gas to the sample surface, where the heated gas enhances low temperature plasma gas desorption and ionization of a sample on the sample surface and guides analyte ions to the intake capillary. A heated gas tube is more proximate to the sample surface than a low temperature plasma tube and provides a heated gas to the sample surface such that low temperature plasma gas desorption of the sample is enhanced. Additionally, a mass spectrometry system includes a mass spectrometer and a low temperature plasma probe coupled to the mass spectrometer.

In an implementation, a method for using a low temperature plasma probe includes providing a low temperature plasma gas using a low temperature plasma source and at least one low temperature plasma tube; providing a heated gas using a heated gas source and at least one heated gas tube, the at least one heated gas tube coupled to the at least one low temperature plasma tube, where the low temperature plasma gas and the heated gas contact a sample; receiving an ionized intake flow using an intake capillary, the intake capillary coupled to the at least one low temperature plasma tube, the ionized intake flow including heated gas, low temperature plasma gas, and ions from the sample; and analyzing the ionized intake flow using a mass spectrometer, the mass spectrometer coupled to the intake capillary.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference number in different instances in the description and the figures may indicate similar or identical items.

DETAILED DESCRIPTION

Figure 1A:
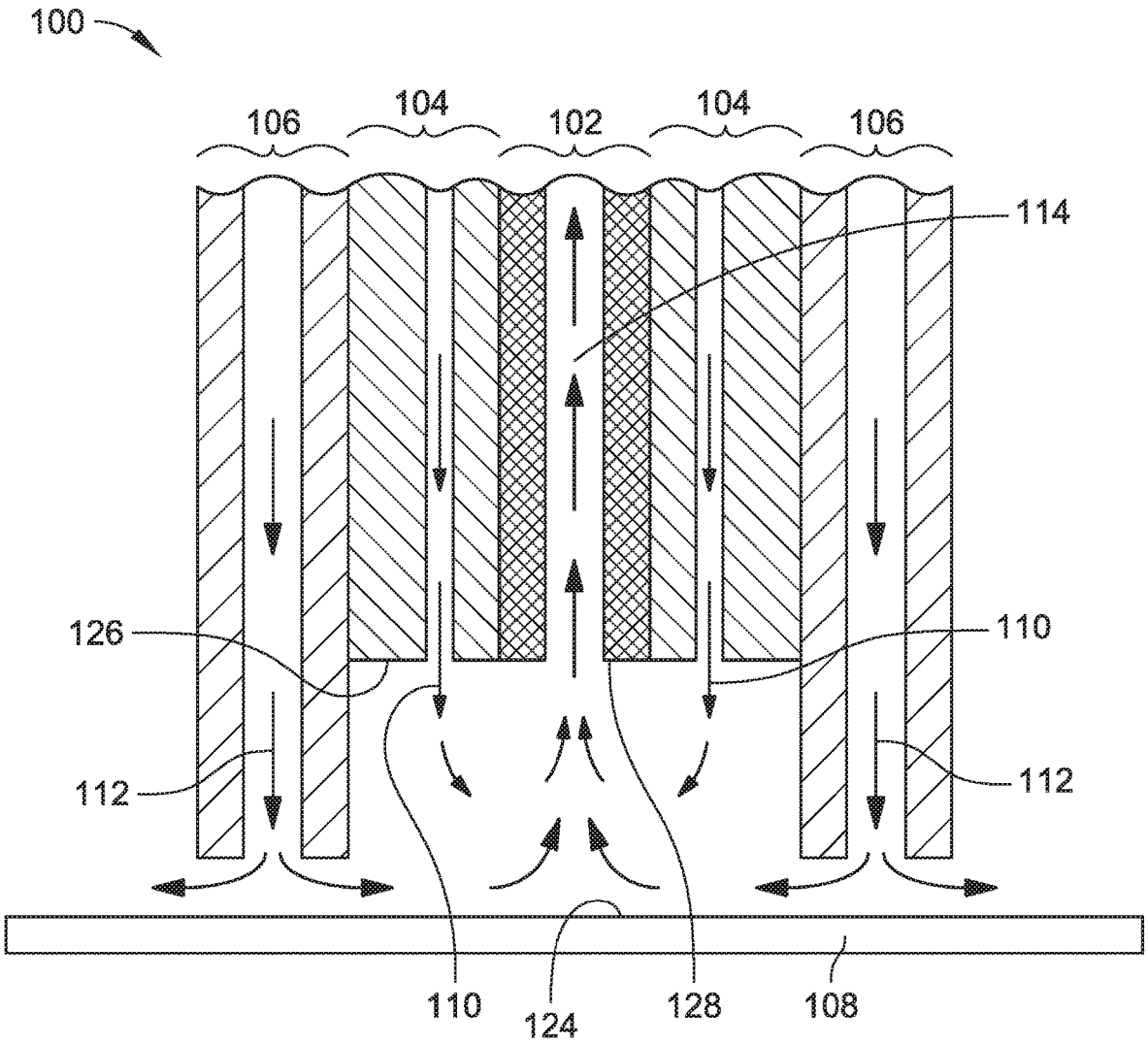
FIG. 1A is a diagrammatic cross-sectional view illustrating a low temperature plasma probe utilizing heated gas tubes in accordance with an example implementation of the present disclosure.

Mass spectrometers (MS) operate in a vacuum and separate ions with respect to the mass-to-charge ratio. In some embodiments using a mass spectrometer, a sample, which may be solid, liquid, and/or gas, is ionized and analyzed. The ions are separated in a mass analyzer according to mass-to-charge ratio and are detected by a detector capable of detecting charged particles. The signal from the detector is then processed into the spectra of the relative abundance of ions as a function of the mass-to-charge ratio. The atoms or molecules are identified by correlating the identified masses with known masses or through a characteristic fragmentation pattern.

Portable mass spectrometer systems have limitations on sample introduction methods into a vacuum manifold because of the smaller pumping systems (most commonly effluent from gas chromatography capillary or flow through a permeable membrane are used). The range of analytes Which can be efficiently examined is thereby limited by the sample introduction and ionization methods employed. One type of portable mass spectrometry includes surface ionization, which involves the creation of ions proximate to an ion source.

Ambient ionization methods can be used in an ion-mobility spectrometry-mass spectrometry (IMS) or a mass spectrometry (MS) system to ionize substances for real-time and in situ chemical analysis without any sample preparation. Among ambient ionization methods are desorption electrospray ionization (DESI), direct analysis in real-time (DART), low-temperature plasma (LTP), direct atmospheric pressure chemical ionization (DAPCI), and many others. One concentric LTP design combines ionization-desorption by low temperature plasma and the transfer of ions formed on/or near the surface/sample using a central capillary. However, the intake flow through the central capillary is larger than the gas flow through the plasma, thus preventing heating of the surface/sample by the plasma gas. This results in reduced sensitivity for the analytes with small vapor pressure, such as RDX, etc.

Another design described using a heat gun to increase substrate temperature: "For those experiments that employed a heated substrate, heating was achieved by directing a heat gun (NTE Electronics, Bloomfield, N.J.) under the sample holder to increase the temperature of the substrate (glass slide) to ~120 C." See Cooks et al., Detection of explosives and related compounds by low-temperature plasma ambient ionization mass spectrometry, *Anal. Chem.,* 2011, 83 (3), pp 1084-1092. However, this arrangement is not practical for real-life problems like inspecting luggage, etc., because it is not feasible to heat the surface from the "tack" side.

It has also been proposed to heat either the gas supplied to low-temperature plasma or the whole LTP probe to facilitate sample desorption from the surface. See Cooks et al., U.S. Pat. No. 9,064,674, and Mester et al., U.S. Patent Pub. No. 2011/0168881. This design does allow an increase of detection sensitivity while using an LTP configuration.

A concentric LTP design with an inner capillary and a concentric outer tube that provides a low temperature plasma cannot use the previous approaches because the heated gas from the plasma doesn't reach the sample surface due to the gas flow through the plasma region is typically 5-10 times smaller than the intake flow though the central capillary. As a result, the heated plasma gas is immediately "sucked in" by this intake flow.

Accordingly, a low temperature plasma probe, a mass spectrometry system, and a method for using a low temperature plasma probe are described. In an embodiment, a low temperature plasma probe includes an intake capillary that provides an ion flow from a sample surface to a mass spectrometer; at least one low temperature plasma tube that provides low temperature plasma gas; at least one heated gas tube that provides heated gas to the sample surface, where the heated gas enhances low temperature plasma gas desorption and ionization of a sample on the sample surface and guides analyte ions to the intake capillary. A heated gas tube is more proximate to the sample surface than a low temperature plasma tube and provides a heated gas to the sample surface such that low temperature plasma gas desorption of the sample is enhanced. Additionally, a mass spectrometry system includes a mass spectrometer and a low temperature plasma probe coupled to the mass spectrometer.

In an implementation, a method for using a low temperature plasma probe includes providing a low temperature plasma gas using a low temperature plasma source and at least one low temperature plasma tube; providing a heated gas using a heated gas source and at least one heated gas tube, the at least one heated gas tube coupled to the at least one low temperature plasma tube, where the low temperature plasma gas and/or the heated gas contact a sample; receiving an ionized intake flow using an intake capillary, the intake capillary coupled to the at least one low temperature plasma tube, the ionized intake flow including heated gas, low temperature plasma gas, and ions from the sample; and analyzing the ionized intake flow using a mass spectrometer, the mass spectrometer coupled to the intake capillary.

The low temperature plasma probe, the mass spectrometry system, and the method for using a low temperature plasma probe described herein provides a simple way of heating a sample surface when using the low temperature probe for direct surface analysis. Previous solutions, such as heating plasma gas from the low temperature plasma probe, are not effective in the case of concentric device geometry. Additionally, heating a sample surface using light requires relatively large devices (e.g. heating lamps or IR lasers), which are not practical for a hand-held probe.

Example Implementations

FIGS. 1A through 1E illustrate embodiments of a low temperature plasma (LTP) probe 100 in accordance with example implementations of the present disclosure. As shown, the LTP probe 100 includes an intake capillary 102, at least one low temperature plasma (LTP) tube 104, and at least one heated gas tube 106.

In the embodiments illustrated in FIGS. 1A through 1F, the LTP probe 100 includes an intake capillary 102 that functions as a sample intake for the LTP probe 100 and/or a mass spectrometer system 134. The intake capillary 102 can include a tube and/or a conduit (e.g., a polymer tube, a metal tube, etc.) configured to provide a gas flow, including heated gas 112, low temperature plasma gas 110, and/or ions from a sample of interest. In some embodiments, the intake capillary 102 can include at least one electrode (e.g., a first electrode) configured to provide a voltage for providing a low temperature plasma gas 110. When an electrical potential is applied to a first electrode (e.g. the intake capillary 102 or other electrode included with the intake capillary 102, such as a needle electrode) and a second electrode (e.g., a low temperature plasma (LTP) tube 104 or other electrode), ions can be formed from gas (e.g., air, Ar, $N_2$, He, etc.) passing through the LTP tube 104.

The LTP probe 100 includes an LTP tube 104 coupled and/or proximate to the intake capillary 102. The LTP tube 104 includes a tube and/or conduit for providing a low temperature plasma gas 110. In some embodiments, the LTP tube 104 can include a polymer tube and/or a metal tube. Additionally, the LTP tube 104 may function as and/or include an electrode (e.g., a second electrode) configured to provide a voltage for providing a low temperature plasma gas 110 in conjunction with a first electrode disposed as a portion of the intake capillary 102. In these embodiments utilizing a first electrode and a second electrode, the LTP probe 100 can include and/or be coupled to a voltage source for providing an electric potential. The electric potential can create an electric field, which further creates a low temperature plasma that a discharge gas flows through and creates a low temperature plasma gas 110 in the LTP tube 104 when the electric potential is sufficiently large. In one specific implementation, the first electrode (e.g., intake capillary 102) and the second electrode (e.g., LTP tube 104) can cause a dielectric barrier discharge for providing a low temperature plasma and/or a low temperature plasma gas 110. A low temperature plasma gas 110 can include high energy electrons with relatively low energy ions and neutrals, which can be used to desorb and ionize analytes from a sample 124 and/or a surface 108 and produce molecular ions of the analytes. Additionally, the LTP tube 104 can be coupled to a gas source 118 (e.g., a pump, a gas cylinder, and/or other gas supply) for providing a low temperature plasma gas 110 (e.g., air, He, $N_2$, Ar, etc.) that flows through the LTP tube 104. In some further embodiments, at least one dopant may be added to the low temperature plasma gas 110. For example, at least one dopant can be introduced through the at least one heated gas tube 106 and/or the LTP tube 104.

In the embodiments illustrated in FIGS. 1A through 1D, the LTP tube 104 is concentric with the intake capillary 102. A concentric LTP tube 104 shares the same length axis as the intake capillary 102 while providing a low temperature plasma gas 110 to a sample 124. In the embodiment illustrated in FIG. 1E, the LTP tube 104 is not concentric with but is coupled to the intake capillary 102.

In some implementations, the LTP probe 100 may be coupled to a probe interface (e.g., a sampling conduit 122), which can include equipment and/or plumbing to supply gas pumped through the LTP tube 104, equipment and/or plumbing to couple the intake capillary 102 to analysis equipment, such as a mass spectrometer 120, and/or equipment and/or plumbing to couple the at least one heated gas tube 106 to a heated gas source 116 (e.g., a resistive heating element, a fan, etc.).

Figure 1B:
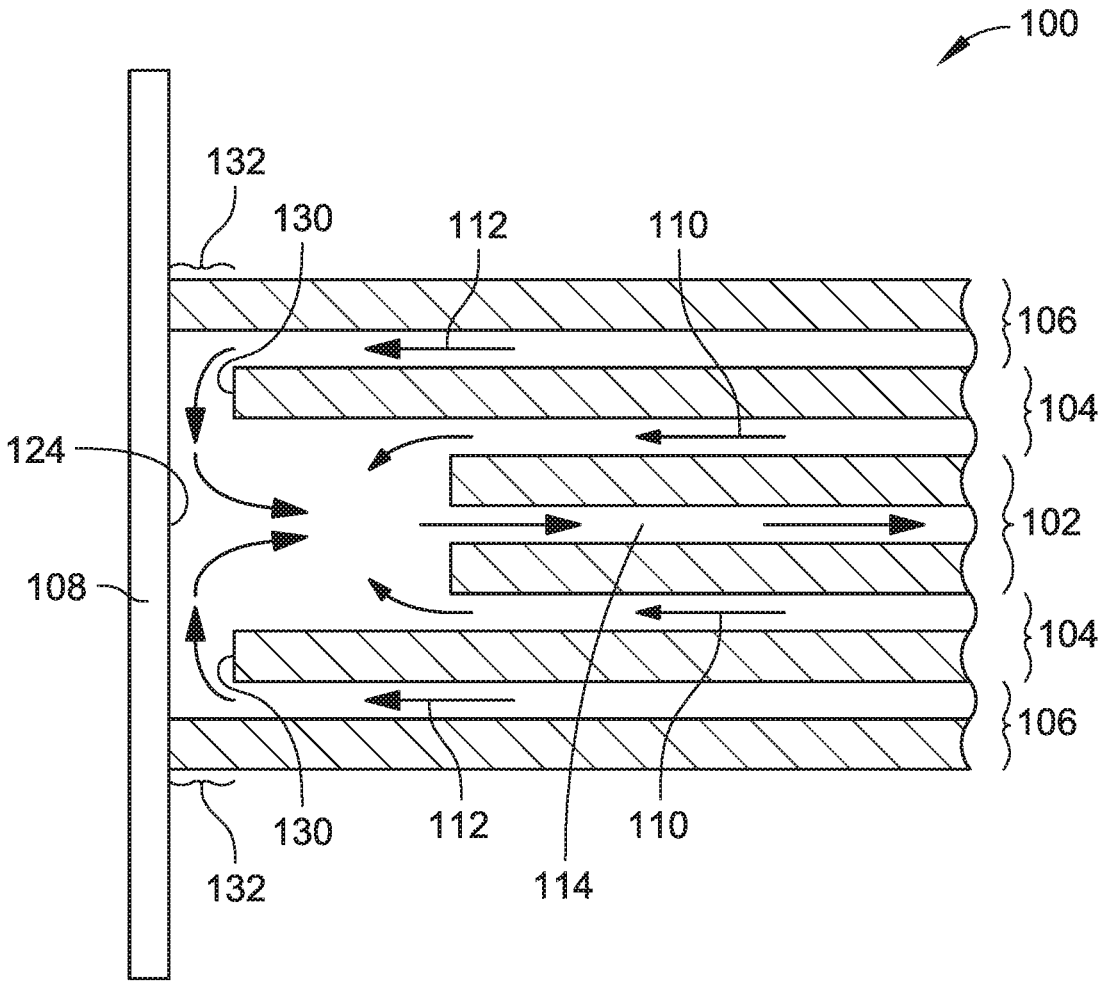
FIG. 1B is a diagrammatic view illustrating a low temperature plasma probe utilizing heated gas tubes in accordance with an example implementation of the present disclosure.

The LTP probe 100 illustrated in FIGS. 1A through 1E includes at least one heated gas tube 106 for providing a heated gas 112. In implementations, a heated gas tube 106 can be coupled to the intake capillary 102 and/or the LTP tube 104, with the heated gas tube 106 extending beyond an LTP tube end 126 (e.g., the tip 132 of the heated gas tube 106) and an intake entrance 128 of the intake capillary 102. This configuration for an extended heated gas tube 106 provides heated gas 112 more proximate to the sample 124, which enhances low temperature plasma gas desorption of the sample 124. Additionally the extended heated gas tube 106 assists in guiding the intake flow to the intake capillary 102. The embodiments shown in FIGS. 1A and 1B illustrate an LTP probe 100 having either two heated gas tubes 106 or one concentric heated gas tube 106 coupled to the LTP tube 104.

FIG. 1B illustrates a specific embodiment of a LTP probe 100 having at least one heated gas tube 106 including a cut out portion 130 of the heated gas tube 106. In this embodiment, an inner portion of the at least one heated gas tube 106 (e.g., a portion most proximate to the intake capillary 102) can be removed, and heated gas 112 can exit the heated gas tube 106 and be guided directly to the intake entrance 128 of the intake capillary 102. In implementations, various amounts of a heated gas tube 106 may be removed to form the cut out 130 (e.g., 0.5 mm, 1 mm, etc.). In this embodiment, the LTP probe 102 is in flush direct contact with a sample surface 108 and the heated gas 112 is directed along the sample surface 108, thus facilitating better sample 124 desorption and subsequent ionization of the sample 124.

Figure 1C:
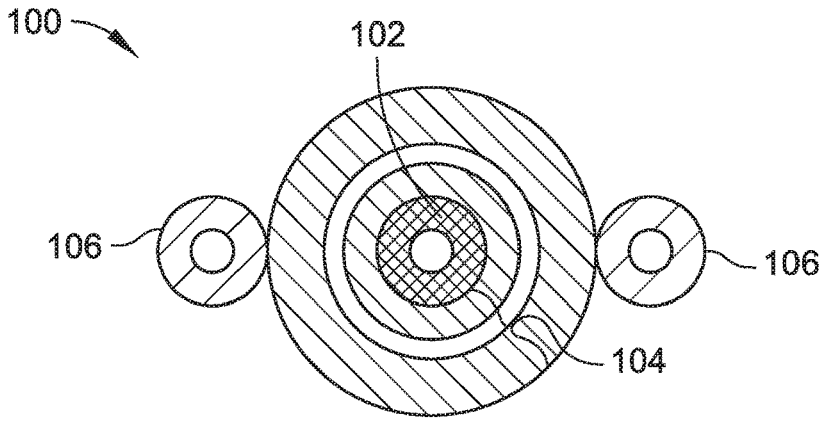
FIG. 1C is a diagrammatic cross sectional end view illustrating a low temperature plasma probe utilizing heated gas tubes in accordance with an example implementation of the present disclosure.
Figure 1D:
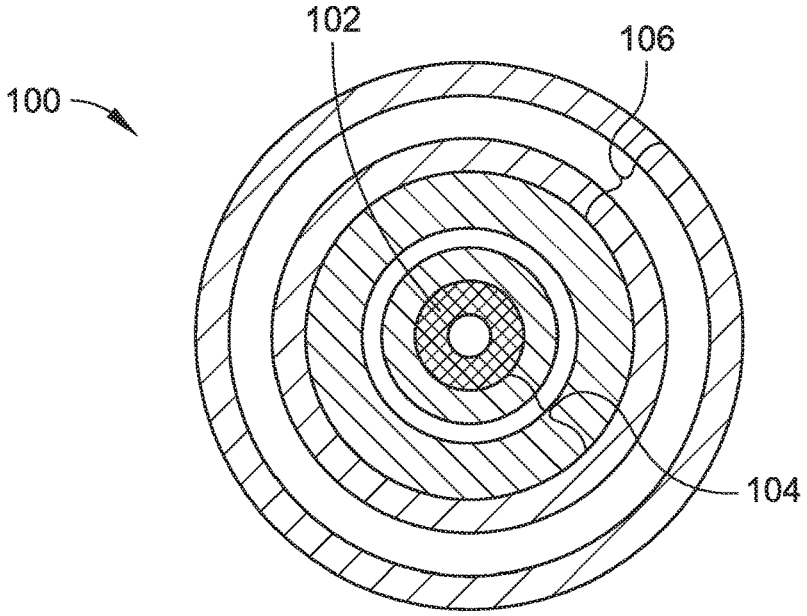
FIG. 1D is a diagrammatic cross sectional end view illustrating a low temperature plasma probe utilizing heated gas tubes in accordance with an example implementation of the present disclosure.
Figure 1E:
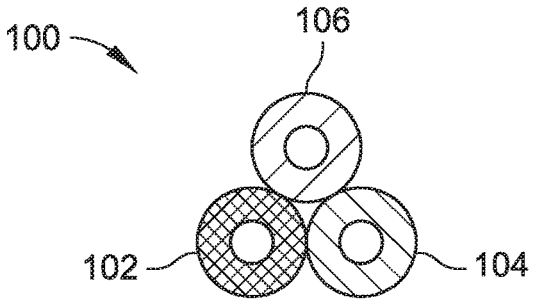
FIG. 1E is a diagrammatic cross sectional end view illustrating a low temperature plasma probe utilizing a heated gas tube in accordance with an example implementation of the present disclosure.

FIGS. 1C through 1E show bottom plan cross sectional views of embodiments of an LTP probe 100. FIG. 1C illustrates a specific embodiment depicting an LTP probe 100 having an intake capillary 102, an LTP tube 104 that is concentric with the intake capillary 102, and two heated gas tubes 106 coupled to opposite sides of the concentric LTP tube 104. FIG. 1D illustrates a specific embodiment depicting an LTP probe 100 having an intake capillary 102, an LTP tube 104 that is concentric with the intake capillary 102, and a heated gas tube 106 that is concentric with the LTP tube 104 and the intake capillary 102. In this specific embodiment, the heated gas tube 106 may or may not include a cut out portion 130 as described above while extending beyond the flush intake entrance 128 and LTP tube end 126. In the specific embodiment illustrated in FIG. 1E, an LTP probe 100 is depicted including an intake capillary 102, an LTP tube 104 coupled in a parallel configuration to the intake capillary 102, and a heated gas tube 106 coupled in a parallel configuration to the intake capillary 102 and the LTP tube 104.

Figure 1F:
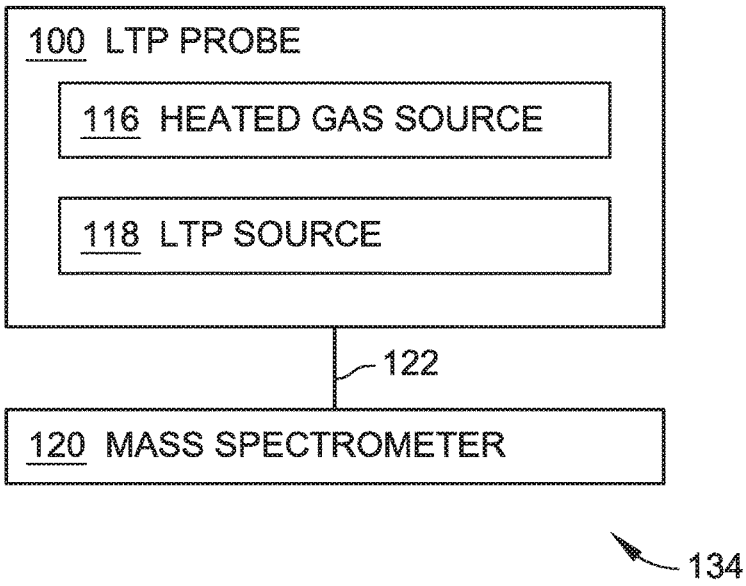
FIG. 1F is an environmental view illustrating a mass spectrometer system utilizing a low temperature plasma probe with at least one heated gas tube in accordance with an example implementation of the present disclosure.

As shown in FIG. 1F, a mass spectrometry system 134 includes an LTP probe 100 coupled to a mass spectrometer 120 (e.g., using a sampling conduit 122, tubing, etc.). In implementations, the mass spectrometer 120 includes a component that separates ionized masses based on charge-to-mass ratios and outputs the ionized masses to a detector. Some examples of a mass spectrometer 120 may include a mass analyzer, a time of flight (TOF) mass analyzer, a magnetic sector mass analyzer, an electrostatic sector mass analyzer, an ion trap mass analyzer, and/or a portable mass spectrometer, etc. In some embodiments, a mass spectrometer 120 may additionally include an ion trap device, which may include multiple electrodes that are used to trap ions in a small volume.

In some specific embodiments, a mass spectrometer 120 may include an ion funnel. An ion funnel can include an assembly of parallel, coaxially arranged ring-shaped apertured diaphragms with tapering internal diameter separated by narrow intermediate spacers. In these implementations, the diameters of the apertures of the diaphragms gradually taper toward the central exit orifice of the ion funnel into the subsequent chamber (e.g., ion guide chamber, mass analyzer system, etc.). The ion funnel may function to focus an ion beam (or ion sample) into a small conductance limit at the exit of the ion funnel. In some embodiments, the ion funnel operates at relatively high pressures (e.g., up to 30 Torr) and thus provides ion confinement and efficient transfer into next vacuum stage (e.g., an ion guide, mass analyzer, etc.), which is at a relatively lower pressure. The ion sample may then flow from the ion funnel into an ion guide and/or mass analyzer.

Additionally, a mass spectrometer 120 may include an ion guide adjacent to and downstream from the ion funnel. In some implementations, the ion guide serves to guide ions from the ion funnel into the mass analyzer while pumping away neutral molecules. In a specific embodiment, an ion guide includes a multipole ion guide, which may include multiple rod electrodes located along the ion pathway where an RF electric field is created by the electrodes and confines ions along the ion guide axis. In some embodiments, the ion guide operates at up to approximately 100 mTorr pressure, although other pressures may be utilized. Additionally, the ion guide may be followed by a conductance limiting orifice, which may have a smaller diameter than the diameter of the exit orifice of the ion guide. In one specific embodiment, a low pressure end of a sampling tube coupled to a mass spectrometer can include an RF ion guide that is positioned close to the inner wall of the sampling tube. This RF ion guide can be configured such that ions and charged particles experience an average net motion away from the sampling tube inner wall over the duration of an RF cycle.

Further, a mass spectrometry system 134 may include a pump, such as a low vacuum pump and/or a high vacuum pump. A vacuum, at least partially created by a low vacuum pump e.g., a diaphragm pump), may be necessary because it can reduce and/or eliminate intermolecular collisions that would otherwise reduce the effectiveness of the mass spectrometry system 134 at separating elements based on their mass-to-charge ratios because molecular collisions may significantly alter the trajectories of ions involved and result in less ions reaching a detector. In embodiments, the vacuum pump can be coupled to at least one vacuum chamber of the mass spectrometer 120. In a specific embodiment, the vacuum pump may include, for example, a scroll vacuum pump. In one specific implementation, the vacuum pump provides a vacuum of approximately up to 30 Torr (e.g., for a vacuum chamber that includes an ion funnel) although it is contemplated that the pump(s) may provide other vacuum pressures as needed.

Example Processes

Figure 2:
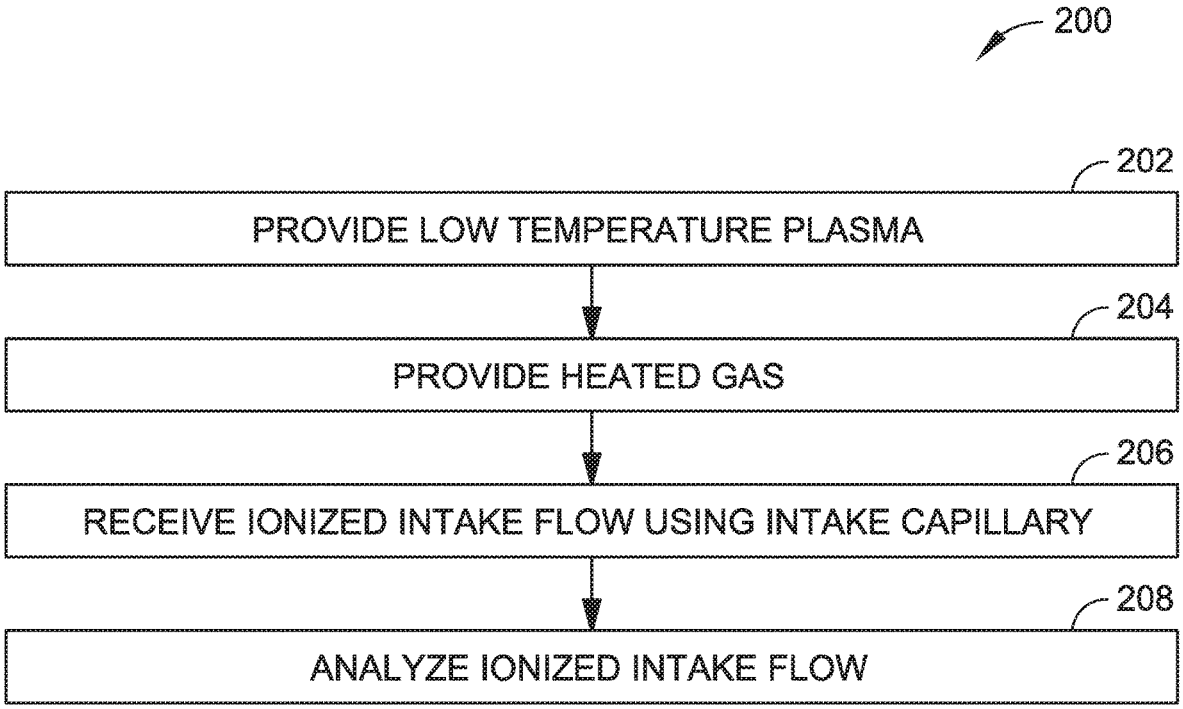
FIG. 2 is a flow diagram illustrating an example process for utilizing the low temperature plasma probe with at least one heated gas tube illustrated in FIGS. 1A through 1F, in accordance with an example implementation of the present disclosure.

FIG. 2 illustrates an example process 200 that employs techniques for using a LTP probe 100 and/or a mass spectrometry system 134, such as the LTP probe 100 and/or mass spectrometry system 134 shown in FIGS. 1A through 1F.

Accordingly, low temperature plasma gas is provided (Block 202). In implementations, a low temperature plasma gas 110 is provided using a low temperature plasma and/or an LTP tube 104. In a specific embodiment, a dielectric barrier discharge method can be utilized to form a low temperature plasma where a voltage can be applied to intake capillary 102 and/or first electrode and the LTP tube 104 and/or a second electrode. A carrier/discharge gas (e.g., He, $N_2$, air, Ar, etc.) can flow through the low temperature plasma to form a low temperature plasma gas 110 that discharges through and/or from the LTP tube 104. It is contemplated that providing a low temperature plasma gas 110 can include using other methods to form a low temperature plasma.

Additionally, a heated gas is provided by at least one heated gas tube (Block 204). The heated gas 112 can be provided using a heated gas source 116, such as a resistive heating element and/or a fan within and/or coupled to a heated gas tube 106. In one specific implementation, providing the heated gas 112 can include using a heated gas source 116 to provide heated air at approximately 60° C. at approximately 1 L/min. It is contemplated that providing a heated gas 112 can include other gases (e.g., Ar, He, $N_2$, etc.), heated gas 112 temperatures (e.g., ambient temperature, 30° C., 35° C., 40° C., 45° C., 50° C., 55° C., 65° C., etc.) and/or other heated gas 112 flow rates (e.g., 0.1 L/min, 0.25 L/min, 0.35 L/min, 0.65 L/min 0.8 L/min, 1 L/min, etc.).

Then, an ionized intake flow is received using an intake capillary (Block 206). In implementations, the intake capillary 102 and/or the mass spectrometer system 134 can provide a suction and/or a vacuum that draws an ionized intake flow 114 into the intake entrance 128 and to the mass spectrometer 120, where the ionized intake flow can include ambient air, heated gas 112, and/or ions from the ionized sample 124.

The ionized intake flow is analyzed using a mass spectrometer (Block 208). Analyzing an ionized intake flow 114 can include using a mass spectrometer 120 and/or a controller coupled to the mass spectrometer 120 to analyze the ion intake flow 114 drawn into the intake entrance 128 and the intake capillary 102. In implementations, an ionized intake flow 114 can flow from the intake capillary 102 to a mass spectrometer 120, which can detect the ions in the intake flow 114 using a detector. A detector can include a device configured to record either the charge induced or the current produced when an ion passes by or hits a surface of the detector. Some examples of detectors may include an electron multiplier, a Faraday cup, and/or ion-to-photon detectors. The controller can receive information regarding the detected ions and compare the information with other empirical/calibration information for providing analysis results a graphical representation, etc.).

Figure 3A:
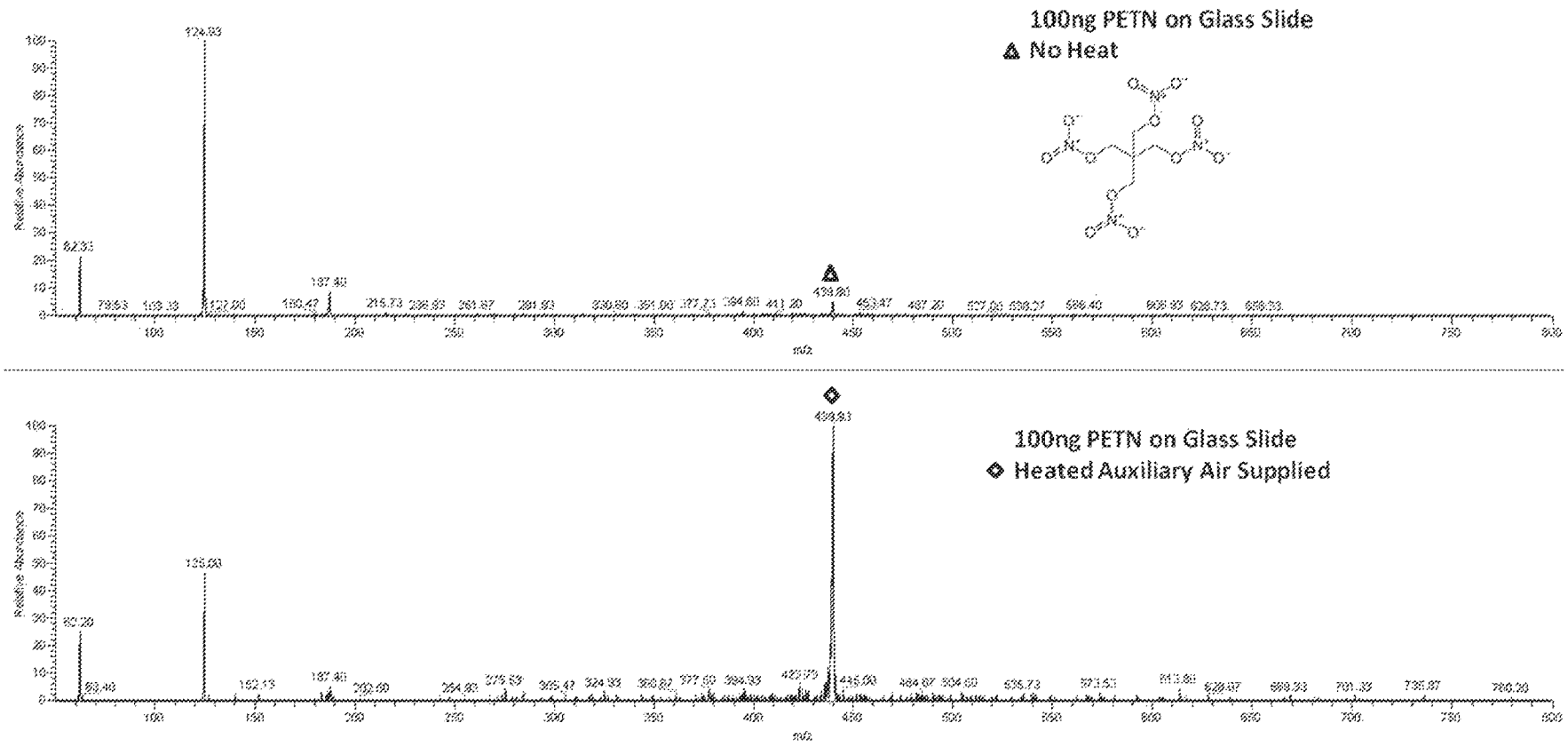
FIG. 3A is a diagrammatic view illustrating a spectral measurement obtained using a mass spectrometer system utilizing a low temperature plasma probe with at least one heated gas tube in accordance with an example implementation of the present disclosure.
Figure 3B:
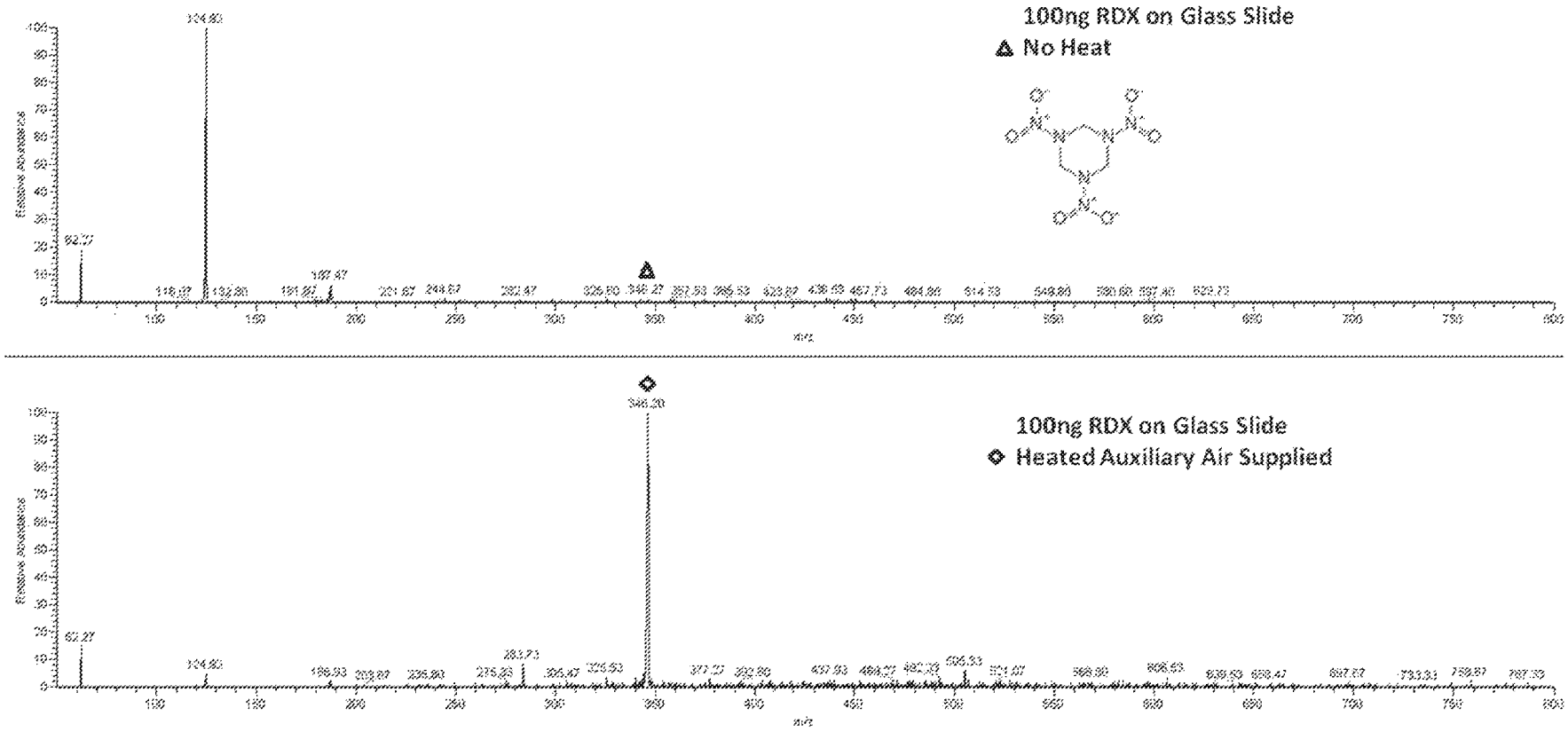
FIG. 3B is a diagrammatic view illustrating a spectral measurement obtained using a mass spectrometer system utilizing a low temperature plasma probe with at least one heated gas tube in accordance with an example implementation of the present disclosure.
Figure 3C:
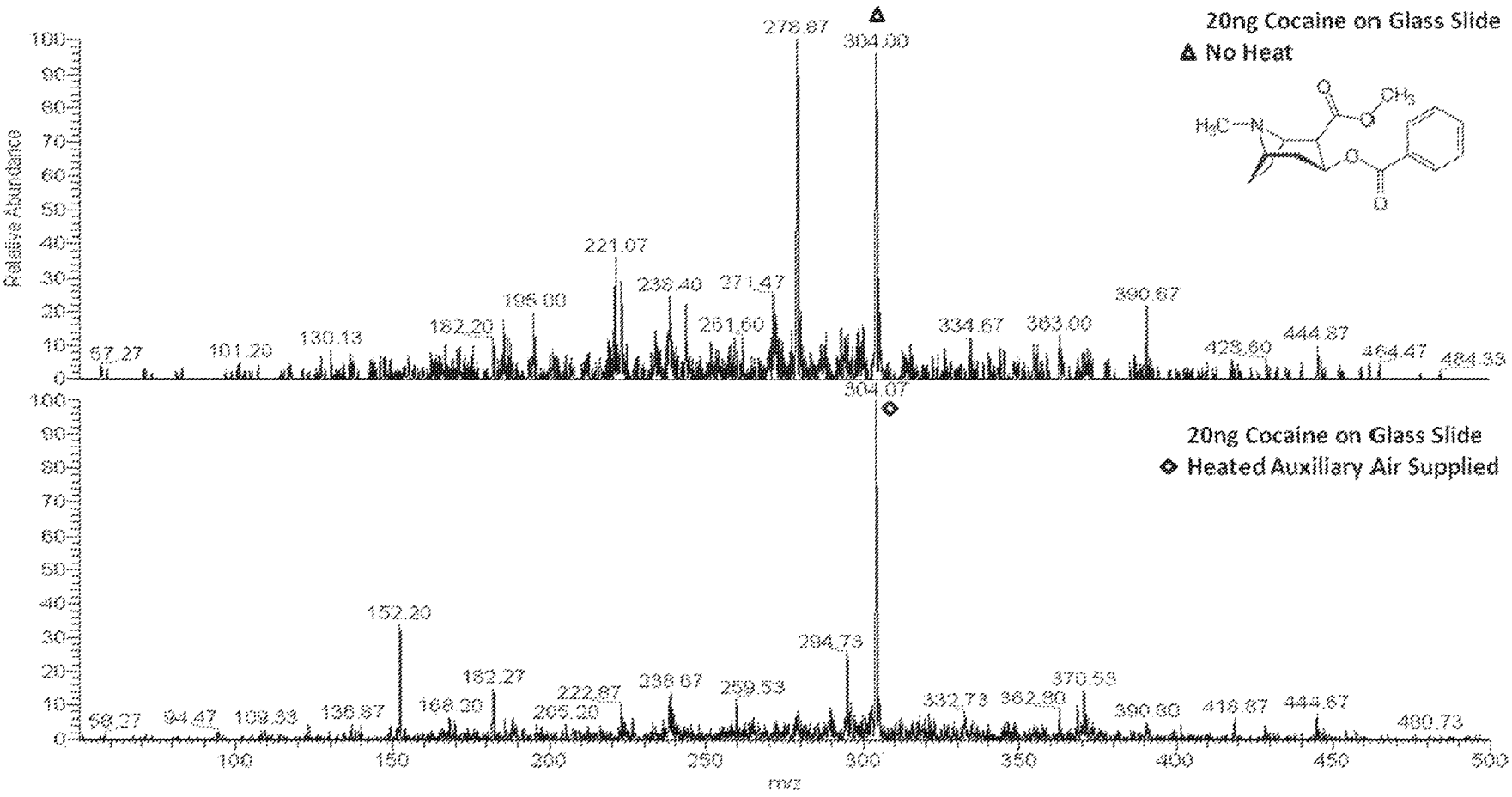
FIG. 3C is a diagrammatic view illustrating a spectral measurement obtained using a mass spectrometer system utilizing a low temperature plasma probe with at least one heated gas tube in accordance with an example implementation of the present disclosure.
Figure 3D:
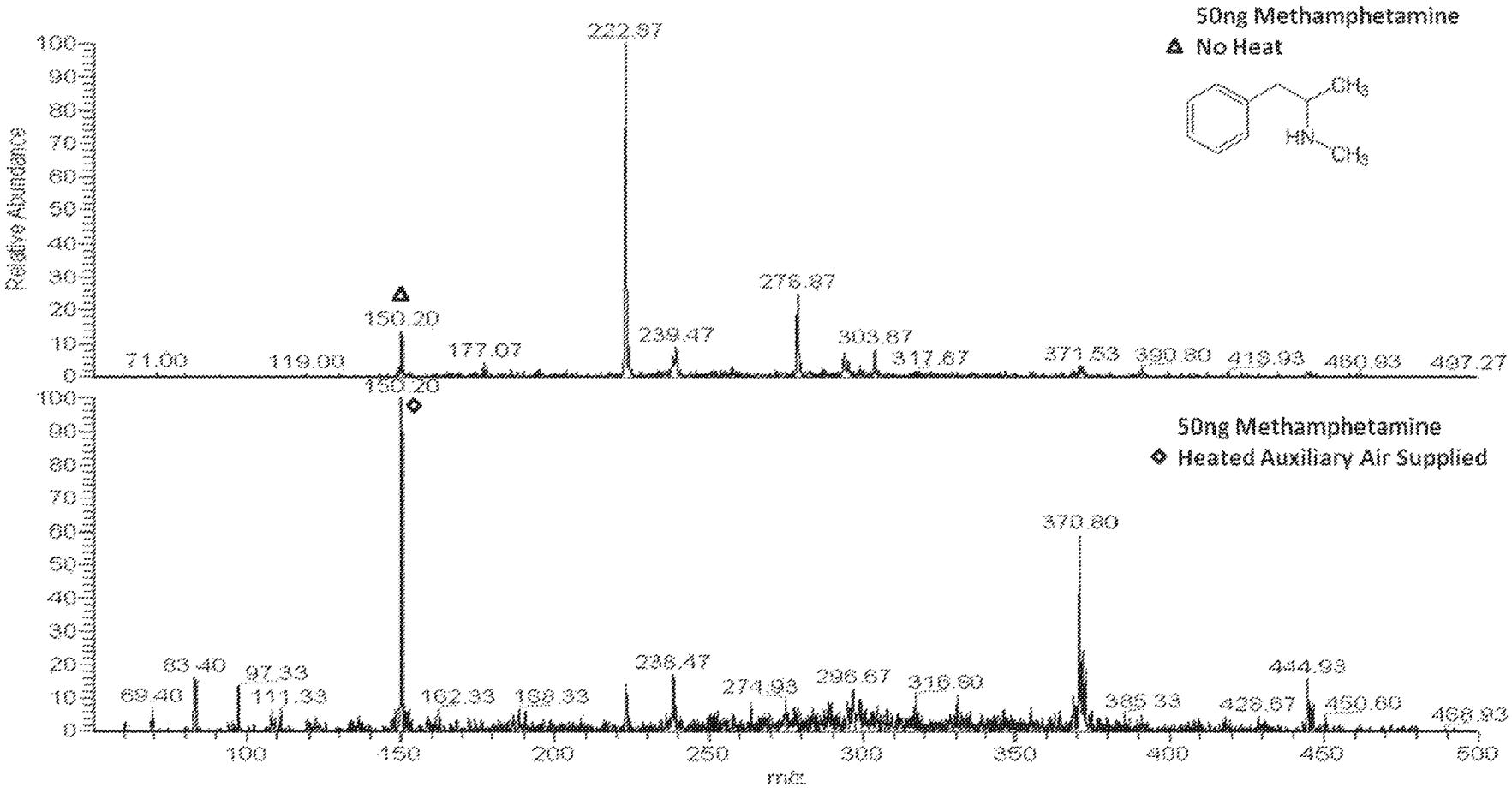
FIG. 3D is a diagrammatic view illustrating a spectral measurement obtained using a mass spectrometer system utilizing a low temperature plasma probe with at least one heated gas tube in accordance with an example implementation of the present disclosure.

FIGS. 3A through 3D illustrate exemplary analysis results that compare using and not using a heated gas 112. FIG. 3A illustrates an analysis of pentaerythriol tetranitrate (PETN) on a glass slide. The top graph illustrates a spectral measurement of 100 ng of PETN not using a heated gas 112, while the bottom graph illustrates a spectral measurement of 100 ng using a heated gas 112, where the peak at 439 mass-to-charge ratio (m/z) indicating PETN is much more evident and results in a better positive indication. FIG. 3B illustrates a spectral measurement of 100 ng of cyclotrimethylenetrinitramine (RDX) on a glass plate, where the bottom graph (with heated gas 112 supplied) illustrates a peak at 346 m/z indicating a presence of RDX, while the top graph (heated gas 112 is absent) does not indicate a peak at 346 m/z. FIG. 3C illustrates a spectral measurement of 20 ng of cocaine on a glass plate, where the bottom graph (with heated gas 112 supplied) illustrates a peak at 304 m/z while the top graph indicates a peak at 304 m/z and at 278 m/z. FIG. 3D illustrates a spectral measurement of 50 ng of methamphetamine, where the bottom graph (with heated gas 112 supplied) depicts an amplified peak at 150 m/z indicating the presence of methamphetamine, while the top graph (heated gas 112 is absent) shows a small peak at 150 m/z. As evidenced by the results shown in FIGS. 3A through 3D, using heated gas 112 with an LTP probe 100 having at least one heated gas tube 106 can give a more accurate positive indication of an ionized substance of interest from sample 124.

Although the invention has been described in language specific to structural features and/or methodological acts, it is to be understood that the invention defined in the appended claims is not necessarily limited to the specific features or acts described. Although various configurations are discussed the apparatus, systems, subsystems, components and so forth can be constructed in a variety of ways without departing from this disclosure. Rather, the specific features and acts are disclosed as example forms of implementing the claimed invention.

What is claimed is:

1. A low temperature plasma probe, comprising:

an intake capillary that provides an ion flow from a sample surface to a mass spectrometer;

at least one low temperature plasma tube that provides low temperature plasma gas;

at least one heated gas tube, separate from the low temperature plasma tube, that provides heated gas to the sample surface, where the heated gas enhances desorption and ionization of a sample on the sample surface.

2. The low temperature plasma probe of claim 1, wherein the intake capillary is configured as a first electrode.

3. The low temperature plasma probe of claim 1, wherein the at least one low temperature plasma tube includes two low temperature plasma tubes disposed on an intake capillary outer surface, and where a low temperature plasma tube end is flush with an entrance of the intake capillary.

4. The low temperature plasma probe of claim 1, wherein the at least one low temperature plasma tube includes an outer tube that is concentric with the intake capillary, and where a gas is pumped through the outer tube, the intake capillary configured as a first electrode and the outer tube configured as a second electrode.

5. The low temperature plasma probe of claim 4, wherein the at least one heated gas tube is concentric to the outer tube and the intake capillary.

6. The low temperature plasma probe of claim 1, wherein air is pumped through the at least one low temperature plasma tube.

7. The low temperature plasma probe of claim 1, where at least one dopant is pumped through the at least one low temperature plasma tube.

8. The low temperature plasma probe of claim 1, wherein the at least one heated gas tube includes one heated gas tube disposed on an outer surface of the at least one low temperature plasma tube, and where the one heated gas tube extends beyond a low temperature plasma tube end and an entrance of the intake capillary, where the low temperature plasma tube end and the entrance of the intake capillary are flush.

9. The low temperature plasma probe of claim 1, wherein the at least one heated gas tube includes two heated gas tubes disposed on an outer surface of the at least one low temperature plasma tube, and where the two heated gas tubes extend beyond a low temperature plasma tube end and an entrance of the intake capillary, where the low temperature plasma tube end and the entrance of the intake capillary are flush.

10. The low temperature plasma probe of claim 1, wherein the at least one heated gas tube includes a cut out portion disposed at a tip of the at least one heated gas tube.

11. The low temperature plasma probe of claim 1, further comprising:

a heated gas source that is coupled to the at least one heated gas tube.

12. The low temperature plasma probe of claim 1, further comprising:

a low temperature plasma source that is coupled to the at least one low temperature plasma tube.

13. A mass spectrometry system, comprising:

a mass spectrometer; and a low temperature plasma probe coupled to the mass spectrometer, the low temperature plasma probe including an intake capillary that provides an ion flow from a sample surface to the mass spectrometer;

at least one low temperature plasma tube that provides low temperature plasma gas;

at least one heated gas tube, separate from the low temperature plasma tube, that provides heated gas to the sample surface, where the heated gas enhances desorption and ionization of a sample on the sample surface.

14. The mass spectrometry system of claim 13, wherein the at least one low temperature plasma tube includes two low temperature plasma tubes disposed on an intake capillary outer surface, and where a low temperature plasma tube end is flush with an entrance of the intake capillary.

15. The mass spectrometry system of claim 13, wherein the at least one low temperature plasma tube includes an outer tube that is concentric with the intake capillary, and where a gas is pumped through the outer tube, the intake capillary configured as a first electrode and the outer tube configured as a second electrode.

16. The mass spectrometry system of claim 15, wherein the at least one heated gas tube is concentric to the outer tube and the intake capillary.

17. The mass spectrometry system of claim 13, where at least one dopant is pumped through the at least one low temperature plasma tube.

18. The mass spectrometry system of claim 13, wherein the at least one heated gas tube includes two heated gas tubes disposed on an outer surface of the at least one low temperature plasma tube, and where the two heated gas tubes extend beyond a low temperature plasma tube end and an entrance of the intake capillary, where the low temperature plasma tube end and the entrance of the intake capillary are flush.

19. The mass spectrometry system of claim 13, wherein the at least one heated gas tube includes a cut out portion disposed at a tip of the at least one heated gas tube.

20. A method for using a low temperature plasma probe, comprising:

providing a low temperature plasma gas using a low temperature plasma source and at least one low temperature plasma tube;

providing a heated gas using a heated gas source and at least one heated gas tube, separate from the low temperature plasma tube, the at least one heated gas tube coupled to the at least one low temperature plasma tube, where a low temperature plasma gas and the heated gas contact a sample;

receiving an ionized intake flow using an intake capillary, the intake capillary coupled to the at least one low temperature plasma tube, the ionized intake flow including heated gas, low temperature plasma gas, and ions from the sample; and analyzing the ionized intake flow using a mass spectrometer, the mass spectrometer coupled to the intake capillary.

* * * * *